United States Patent [19]

Schechter et al.

[11] Patent Number: 4,583,509

[45] Date of Patent: Apr. 22, 1986

[54] DIESEL FUEL INJECTION SYSTEM

[75] Inventors: Michael M. Schechter, Southfield; Aladar O. Simko, Dearborn, both of Mich.

[73] Assignee: Ford Motor Company, Dearborn, Mich.

[21] Appl. No.: 689,202

[22] Filed: Jan. 7, 1985

[51] Int. Cl.[4] ..... F02M 39/00

[52] U.S. Cl. ..... 123/451; 123/458; 417/442

[58] Field of Search ..... 123/451, 446, 458, 447; 417/442

[56] References Cited

U.S. PATENT DOCUMENTS

| | | | |
|---|---|---|---|
| 1,664,608 | 4/1928 | French | 123/458 |
| 2,016,503 | 10/1935 | Kenworthy | 417/442 |
| 2,287,702 | 6/1942 | Nichols | 123/446 |
| 3,744,465 | 7/1973 | Voss | 123/451 |
| 4,379,442 | 4/1983 | Simko | 123/458 |
| 4,459,963 | 7/1984 | Gross | 123/458 |
| 4,479,475 | 10/1984 | Babitzka | 123/458 |
| 4,497,299 | 2/1985 | Schechter | 123/451 |

*Primary Examiner*—Carl Stuart Miller

*Attorney, Agent, or Firm*—Clifford L. Sadler; Robert E. McCollum

[57] ABSTRACT

A fuel injection pump includes a number of plungers of the fill/spill port control type, the plungers being hydraulically connected in pairs and through a single shuttle valve to a single fuel spill port controlled by a single solenoid controlled spill valve, the plungers being operable in sequence and in succession to condition one plunger at a time for fuel pressurization while the remaining plungers are in various other phases of operation refilling their fuel chambers with fuel or preparing the air fuel chamber for pressurization.

7 Claims, 17 Drawing Figures

10
74
44
48
46
IA
32
34
36
12
54
16
62
64
42
50
14
56
58
60
16
24
22
126
20
IA 68
38
66
72
70
52
32
28
24
22
18
30
40
16
14
20
26

DIESEL FUEL INJECTION SYSTEM

This invention relates in general to an automotive diesel type fuel injection pump. More specifically, it relates to one in which the fuel is displaced by cam driven plungers, and fuel metering and injection timing control is performed by means of electronically controlled solenoid valves which vary the duration and timing of spill port closing.

Application of the above type of spill control to diesel fuel injection systems encounters difficulties associated with the high pumping rate and high injection pressure inherent in diesel fuel injection. High pumping rate aggravates the problem of uneven port to port fuel distribution resulting from the inevitable differences in the response time of individual solenoids controlling the output from individual ports. High injection pressure subjects the solenoid valve to very high pressure forces.

This invention attempts to solve these problems by providing a pump in which a single solenoid valve is sequentially connected to all plunger barrels in the pump in succession and controls the timing and output from all ports in a distributive manner, which will eliminate the problem of solenoid to solenoid variations inherent in multi-solenoid arrangements.

Plunger type fuel injection pumps with solenoid controlled spill ports are known. For example, U.S. Pat. No. 4,379,442, Simko, assigned to the assignee of this invention, shows such a construction. However, Simko requires a separate solenoid for control of the flow from each plunger fuel chamber in the engine.

U.S. Pat. No. 4,497,299, Schechter, Plunger Type Fuel Injection Pump, also assigned to the assignee of this invention, shows a multi-plunger, spill port type pump having a single solenoid controlling the fuel flow operation with respect to two plungers. However, a fuel distribution plunger activated by the camshaft also is required in combination with each of two fuel pumping plungers.

U.S. Ser. No. 689,126, Schechter, et al, "Electromagnetic Distributor Type Multiplunger Fuel Injection Pump", filed Jan. 7, 1985, again assigned to the asignee of this invention, also shows a multi-plunger, spill port type pump having a single solenoid controlling the pressurization of a pair of fuel chambers by the use of a shuttle valve. However, a solenoid controlled valve and a shuttle valve are required for each pair of plungers.

As stated above, the fuel injection pump of this invention provides an efficient and economical construction controlling the pressurization of all of the pump plunger chambers by the use of only a single solenoid controlled valve and a single hydraulically operated shuttle valve.

A further feature of the invention is the provision of a spill port control valve designed to be insensitive to the magnitude of the injection pressure acting against it.

Other features and advantages of the invention will become more apparent upon reference to the succeeding, detailed description thereof, and to the drawings illustrating the preferred embodiments thereof; wherein, FIG. 1 is a cross-sectional view of a portion of an internal combustion engine incorporating a fuel injection pump embodying the invention;

Figure 1:
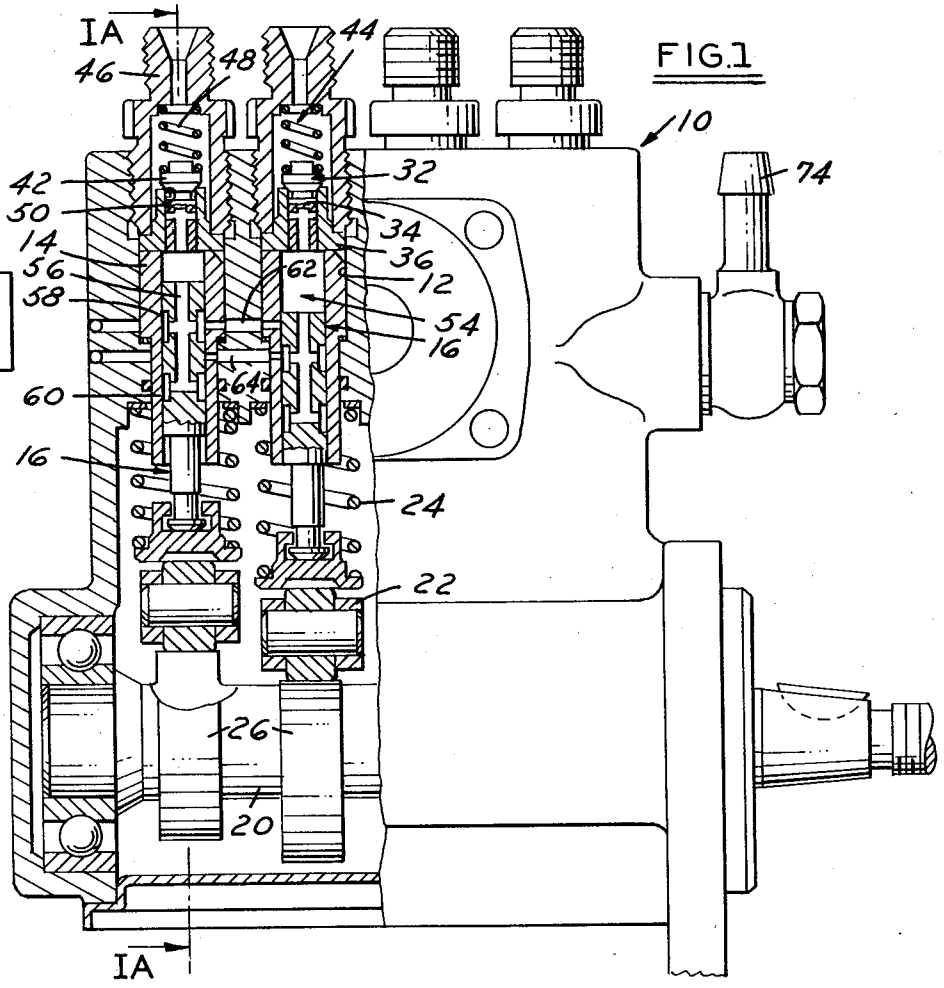
FIG. 1A is a cross-sectional view taken on a plane indicated by and viewed in the direction of the arrows IA—IA of FIG. 1.
Figure 1A:
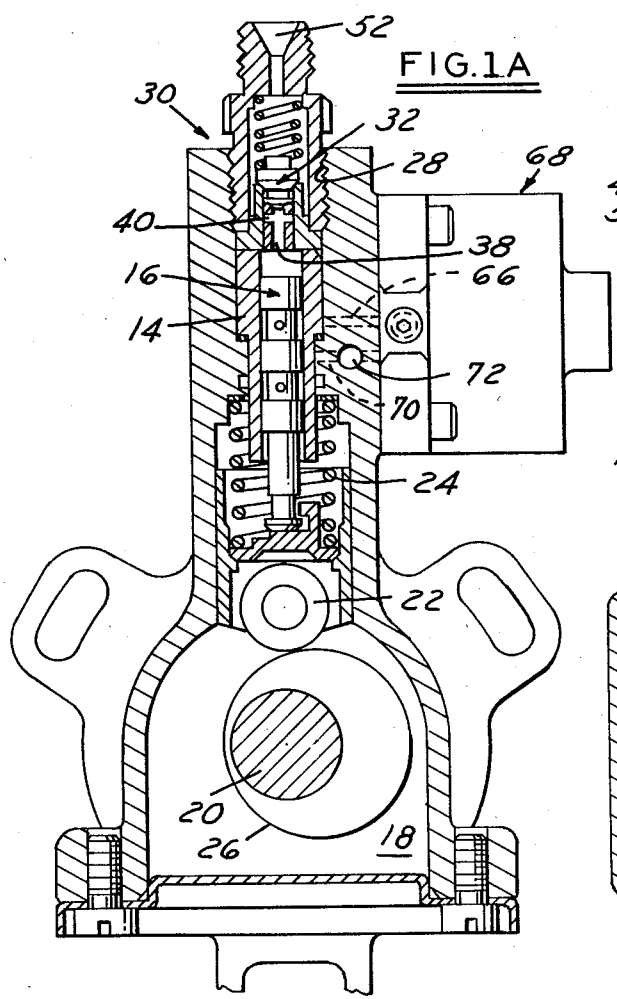

FIGS. 1 and 1A illustrate schematically a cross-sectional view of a portion of a four cylinder internal combustion engine incorporating a fuel injection pump constructed according to the invention. It includes a housing 10 having in this case two pair of axially spaced, radially extending bores 12 within each of which is fixed a stationary pump plunger barrel 14. In each of the barrels is reciprocably mounted a pump plunger 16. Housing 10, which is aluminum in this case, has a central cavity 18 within which is received a short engine driven camshaft 20. The camshaft is rotatably mounted at opposite ends on a pair of ballbearing units, and drives each of the plungers through a roller tappet assembly 22 secured to the plunger. A return spring 24 forces the plunger and tappet against the cam 26.

Camshaft 20, in this case, as best seen in FIG. 1, is formed with four (only two shown) individual cams 26 that are eccentrically mounted for reciprocation of the pumping plungers 16 engageable therewith. The bottom of plungers are flat and ride directly on the cams. While not shown, the cam profile would consist of an acceleration ramp, a constant velocity portion (Archimedies spiral) and a deceleration ramp.

The upper end of housing 10 is formed with a cup-shaped recess 28 in which is fixedly mounted a fuel delivery valve assembly 30. The assembly includes a known type of retraction delivery valve 32. It has a lower land 34 of a diameter that mates with the diameter of a subhousing 36 in which it is slidably mounted. An axial bore 38 through the lower land connects fuel to a crossbore 40. A second larger diameter conical land 42 formed at its upper end and spaced axially from crossbore 40 moves into a fuel chamber 44 formed in the upper end of the delivery valve housing 46. A spring 48 biases the delivery valve onto a mating seat 50 formed in subhousing 36. A throughbore 52 connects the upper end of fuel chamber 44 to a fuel injection line for the individual injection of fuel into an engine cylinder in a known manner.

The space between the lower end of subhousing 36 of the delivery valve and the top of each plunger 16 defines a fuel fill/spill chamber 54. The chamber alternately is pressurized with fuel to a level sufficient to open delivery valve 32 for delivery of fuel to an individual engine cylinder during the pumping stroke of its respective plunger 16, or replenished with fuel during the intake stroke of plunger 16. The pressurization of fuel in chamber 54 is controlled by an electromagnetically controlled spill port type construction, which will be described in more detail later. Briefly, when the spill port is blocked, the pressurization stroke of one of the plungers will pressurize its fuel chamber while the fuel chambers of the remaining plungers will be in various other stages of operation; i.e., refilling with fuel or readying for pressurization.

FIG. 1 shows each of the pump plungers having an internal axial bore 56 connecting its fuel chamber 54 to a pair of axially spaced annular side grooves 58 and 60. The plunger barrels are connected in pairs. The two plunger barrels on the left side of the pump as seen in FIG. 1 are connected by means of two passages, an upper passage 62 and a lower passage 64. A fuel spill/fill passage 66 (FIG. 1A) leads from the upper connecting passage 62 to a spill port controlled by a solenoid valve assembly 68 to be described later. A supply passage 70 leads from the lower connecting passage 64 to a main supply gallery 72 supplied with fuel through a fitting 74 connected to a low pressure supply pump, not shown. The two plunger barrels on the right side of the pump are interconnected and connected to the solenoid valve assembly 68 and supply gallery 72 in the same manner.

The relative axial spacing of the grooves 58 and 60 is such that when the fuel chamber above the plunger 16 is in communication with upper connecting passage 62, it is out of communication with the lower connecting passage 64, and vice versa. Thus, the chamber 54 above the plunger is connected either to be controlled by the solenoid assembly 68 or connected to the supply gallery 72, as a function of the plunger position. The phase shift in the movements of the two interconnected plungers, which is dictated by the design of the camshaft, is such that as shown, when one of the two plunger barrels is connected to the spill port controlled by solenoid valve 68, when on its pumping stroke, the other is connected to the supply gallery 72, and vice versa. The working order of the pump is such that when one pair of interconnected plungers is moving upward, the other pair of plungers is moving downward.

In operation, as thus far described, so long as spill/fill passage 66 remains unblocked by the solenoid assembly, upward movement of one of the plungers 16 on its pumping stroke will merely move the fuel in chambers 54 out through passage 66 and back into the feed line. When spill/fill passage 66 is blocked by the solenoid assembly to be described, plunger 16 then can pressurize the fuel in chamber 54 to a level sufficient to move the delivery valve 32 upwardly against the preload of spring 48 to open th fuel line 52 and thereby provide fuel to the individual cylinder. When plunger 16 again moves downwardly on its intake stroke, the solenoid will be deenergized, and the pressure of fuel in injection line 52 will fall to a point where spring 48 again will be able to move the delivery valve 32 downwardly into the bore of subhousing 36. The first effect is for the top edge of bore 40 to engage the bore of the subhousing and shut off the communication of fuel between the bore and line 52. The second effect upon continued movement of the delivery valve 32 is to decrease the residual pressure in the fuel injection line and delivery valve chamber 48 by the mass of the retraction valve moving downwardly into the lower end of the subhousing 36, which increases the effective volume in the spring chamber.

FIG. 1 shows a fuel injection pump assembly of the axially aligned plunger type suitable for an in-line four cylinder engine, for example. It will be clear, of course, that the invention would be equally applicable, however, to a V-type engine, where two separate banks of fuel injection pump assemblies would be interconnected in pairs.

Figure 2:
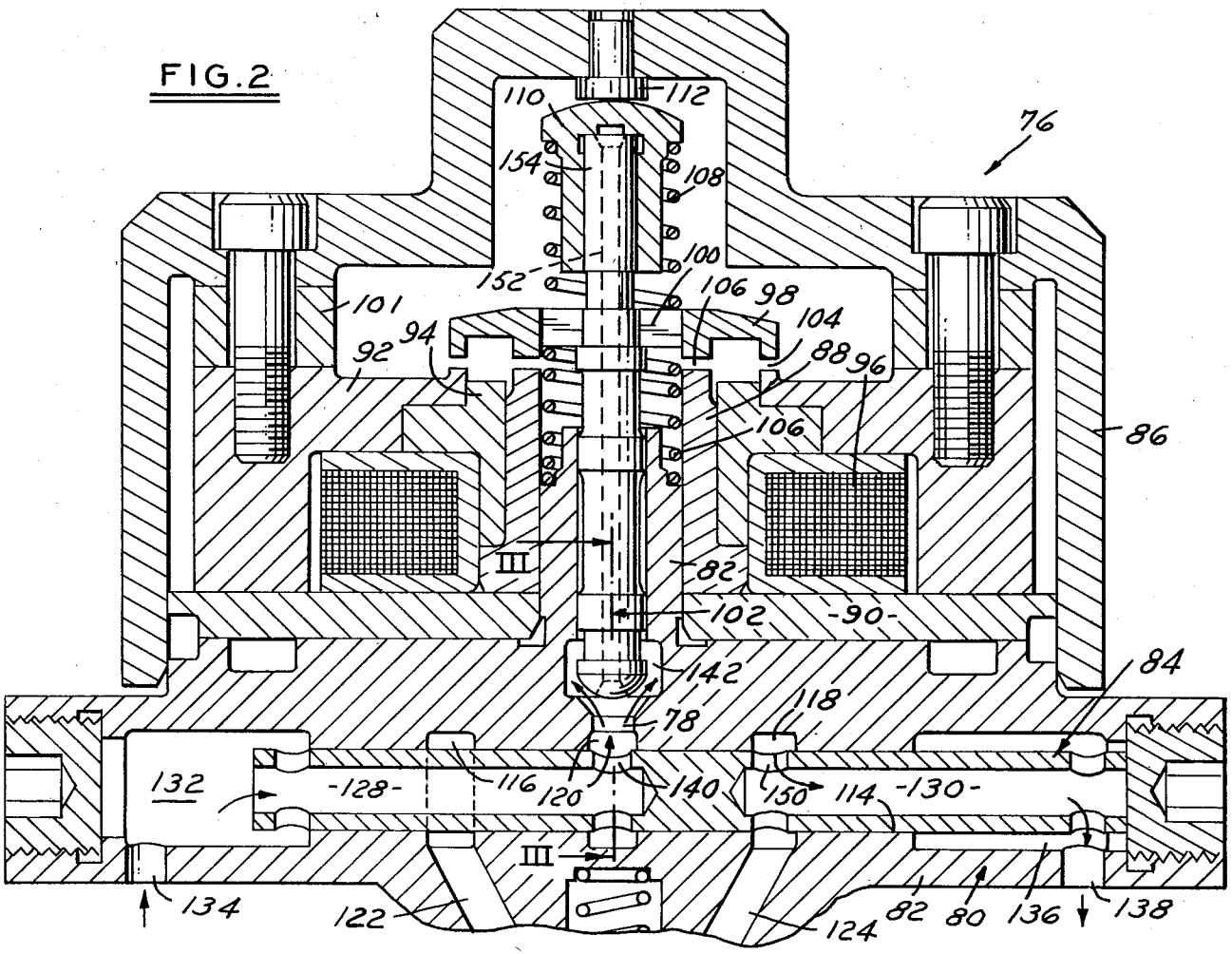
FIG. 2 is an enlarged cross-sectional view of a detail of FIG. 1.
Figure 4:
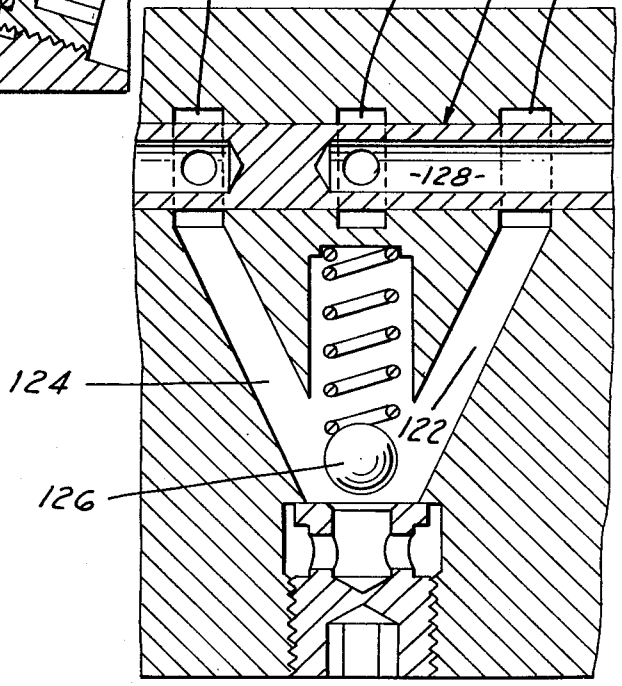
FIGS. 3 and 4 are cross-sectional views taken on planes indicated by and viewed in the direction of arrows III—III and IV—IV of FIGS. 2 and 3, respectively.
Figure 3:
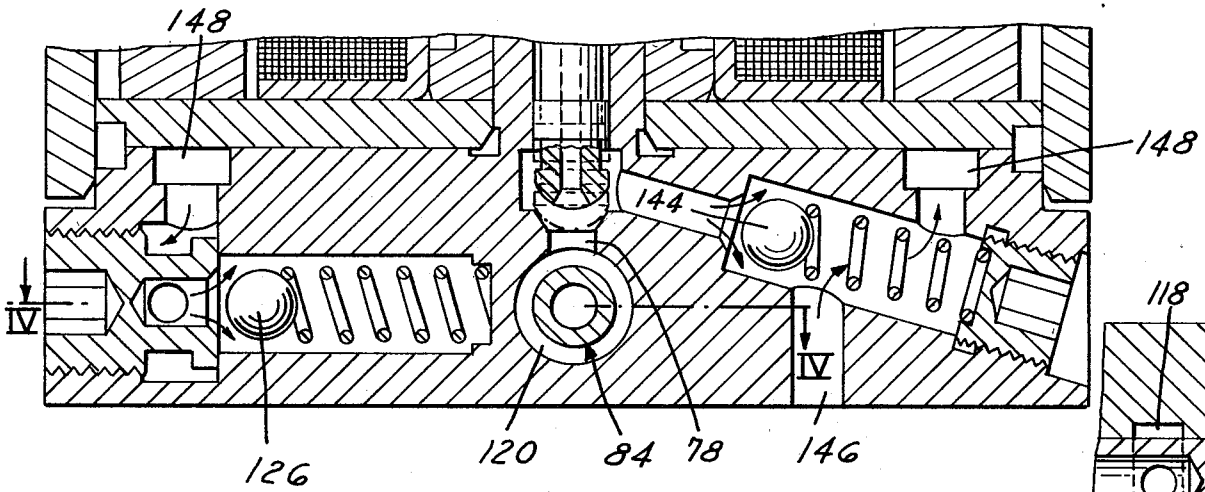

FIGS. 2, 3 and 4 illustrate more clearly an electromagnetically operated spill port control valve assembly 68 to control the opening or closing of a fuel spill port 78. In this case, a common spill port is used to control the spillage of fuel from all of the plungers successively and in sequence in a manner such that when one fuel plenum 54 is being pressurized with fuel upon closing of the spill port valve, the remaining plunger fuel chambers will be in various other phases or stages of refilling with fuel or preparing to be pressurized in the next sequence of events.

More particularly, the electromagnetically controlled valve means includes a two piece housing 80 including a lower valve body 82 that contains a shuttle valve 84, and an upper solenoid housing 86. The upper housing encloses a solenoid assembly that includes a core consisting of an inner sleeve 88 located on a washer 90, and an outer core 94, all made of soft magnetic material, and an intermediate sleeve 94 made of antimagnetic material. Enclosed inside the core is a solenoid coil 96, and the entire assembly is bolted to valve housing 86. The solenoid armature 98, made of soft magnetic material, and an inner hub 100, made of antimagnetic material, are permanently attached to a spool valve type spill port control valve 102. The solenoid housing 86, made of antimagnetic material, is bolted to the outer core 92 with a washer 101 sandwiched in-between. Since the antimagnetic intermediate sleeve 94 separates the outer core 92 from the inner sleeve 88, the magnetic flux must flow through the outer annular airgap 104 between outer core 92 and armature 98 and then back through the inner airgap 106 between armature 98 and sleeve 88.

A pair of springs 106, 108 act on the hub 100, the spring 106 being seated between the hub 100 and the valve housing 82; the spring 108 seating between the hub 100 and a cap 110. The cap is slidingly installed on the upper part of spill valve 102. The installed preload of spring 106 is higher than that of spring 108. Therefore, when the solenoid is not energized, the net spring force keeps the spill valve 102 open with the cap 110 pressed against a stop 112. When the solenoid is energized, the magnetic force overcomes the spring forces and the spill valve 102 closes the spill port 78. Controlling the thickness of the washer 90 controls the solenoid airgap in the closed valve position. The thickness of washer 101 controls the solenoid air gap in the open valve position.

As stated previously, one of the features of the invention is to provide for the control of spillage of fuel from all of the pump plunger chambers in sequence and succession by the use of a single solenoid controlled spill port valve. To accomplish this, the valve housing 80 includes a shuttle valve 84. The shuttle valve 84 is cylindrical in shape and is slidingly installed in a cylindrical barrel 114 machined in valve body 82. Three annular grooves 116, 118 and 120 interrupt the surface of the shuttle barrel. The annulus 120 opens into the spill port 78. The annuli 116 and 118 are connected through two passages 122 and 124, respectively, with a spring seated inlet check valve 126 (FIG. 4). Two axial bores 128 and 130 are drilled in the shuttle valve. The bore 128 opens into an end chamber 132 (FIG. 2) from which a port 134 leads to the passage 66 (FIG. 1A) and connecting passage 62 (FIG. 1). The bore 130 opens into an end chamber 136, from which a port 138 leads to the other pair of plunger barrels.

When the two plungers connected to the port 134 displace fuel into the chamber 132, the shuttle valve 84 is in the extreme right position shown in FIG. 2. Fuel flows through the axial bore 128 and cross hole 140 to the annulus 120 and from there through the normally open spill port 78 into the spill chamber 142. From there, the fuel exits through the spring closed outlet check valve 144 (FIG. 3). Due to the check valve, the pressure in the chamber 132 at this time will be higher than that in the chamber 136, and this pressure differential firmly keeps the shuttle valve 84 in the extreme right position. At the same time, fuel from the pump main supply gallery through 74 (FIG. 1), 72 (FIG. 1A), and 64 (FIG. 1) supplies fuel to the solenoid valve assembly through a passage 146 (FIG. 3), and through a circular channel 148 reaches the inlet check valve 126. From the check valve, the fuel flows through the passage 124 to the annulus 118 FIG. 4). From the annulus 118, the fuel flows through the cross hole 150 (FIG. 2), axial bore 130, and port 138 to the other pair of plungers.

When the solenoid is activated or energized, the magnetic traction force pulls the armature 98 towards the solenoid core, and the spill valve 102 closes the spill port 78. As a result, the plunger that currently was displacing fuel through the spill port now will inject fuel into the engine cylinder with which it is connected by means of its injection line 52. The injection will continue until the solenoid is deactivated and spill port 78 reopens. Controlling the duration and timing of the solenoid voltage pulse will control the fuel delivery and injection timing.

When a change in the direction of plunger movement occurs, the direction of fuel flow is reversed, and the fuel begins to flow from one of the plungers on the right side of FIG. 2 towards the spill port 78 through the port 138 and from the spill port 78 to the plunger barrels on the left side through the port 134. The inlet check valve 126 and the outlet check valve 144 close temporarily, and the rising pressure in the chamber 136 shifts the shuttle valve 84 into its extreme left position. In this position, the cross hole 140 will be in register with the annulus 116, which through passage 126 is connected with the inlet check valve 126 (FIG. 3). The cross hole 150 will align itself with the annulus leading to the spill port.

The entire sequence of operation of the pump and the solenoid controlled spill port valve during a single pump revolution is diagramatically depicted in FIGS. 5–5A, 6–6A, 7–7A and 8–8A in steps of 90° camshaft rotation. The four plungers 16 are individually identified as 1, 2, 3, 4 and the working order of the plungers for injection is 1-2-4-3. For the sake of simplicity of explanations, the diagrams show two inlet check valves 126 instead of one.

Figure 5:
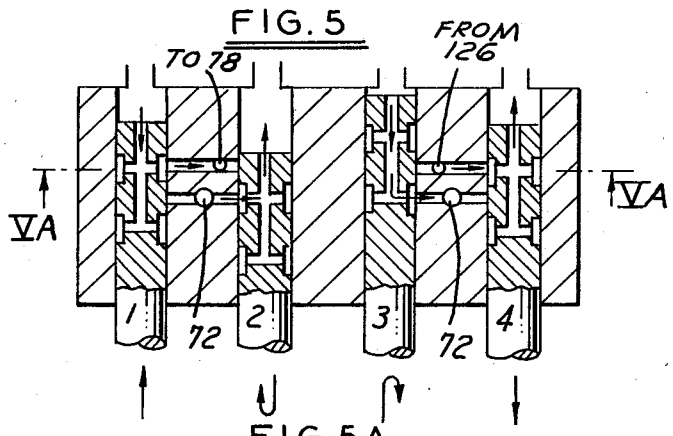
Figure 5A:
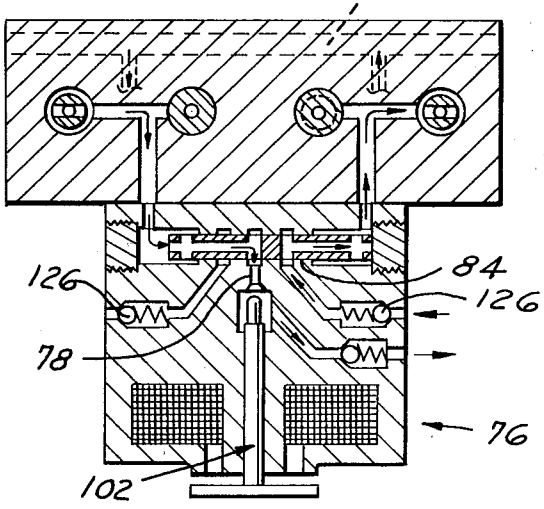

In FIGS. 5 and 5A, the shuttle valve 84 is in the extreme right position. Plunger No. 1 is in the middle of the upstroke, and its plunger barrel is in communication with the spill port 78. Plunger No. 2 approaches the bottom dead center position (BDC) and its plunger barrel is in communication with the supply gallery 72 (FIG. 5). Plunger No. 3 approaches the top dead center (TDC) and its plunger barrel is also in communication with the supply gallery 72. Plunger No. 4 is in the middle of the downstroke, and its plunger barrel is in communication with the inlet check valve 126 (FIG. 5A). Activation of the solenoid closing the spill port 78 results in injection of fuel by Plunger No. 1 past its delivery valve to an individual engine cylinder.

Figure 6:
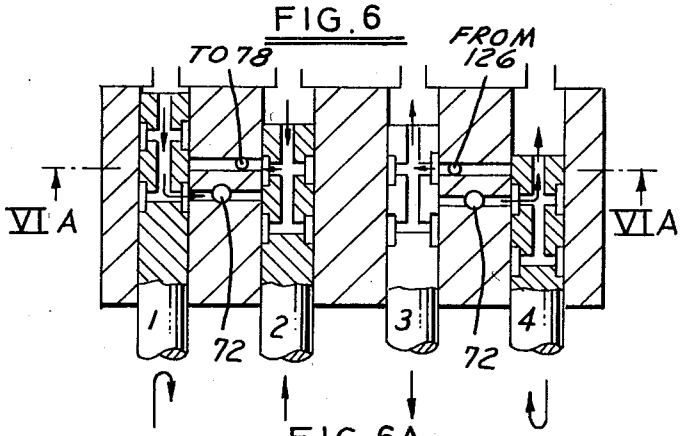
FIGS. 5–8 are schematic cross-sectional views showing the sequential operation of the pump plungers in various phases of operation.
Figure 6A:
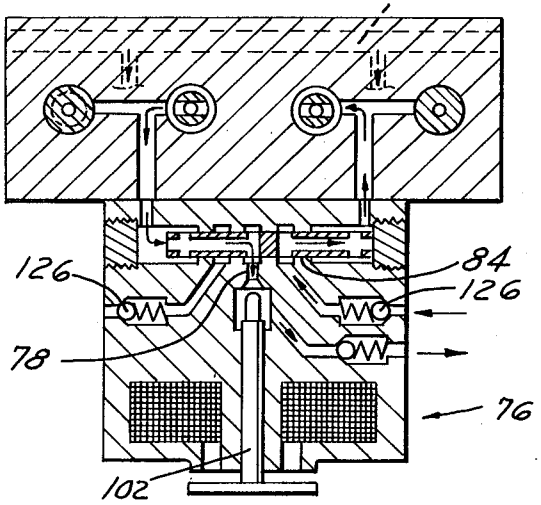
FIGS. 5A, 6A, 7A and 8A are cross-sectional views taken on planes indicated by and viewed in the direction of the arrows VA—VA, VIA—VIA, VIIA—VIIA and VIIIA—VIIIA of FIGS. 5–8, respectively.

In FIGS. 6 and 6A, the shuttle valve is still in the extreme right hand position. Plunger No. 1 approaches the TDC, and its plunger barrel is in communication with the supply gallery 72. Plunger No. 2 is in the middle of the upstroke, and its plunger barrel is in communication with the spill port 78. Plunger No. 3 is in the middle of the downstroke and its plunger barrel is in communication with the inlet check valve 126. Plunger No. 4 is approaching the BDC and its plunger barrel is in communication with the supply gallery 78. Activation of the solenoid results in injection of fuel by Plunger No. 2.

Figure 7:
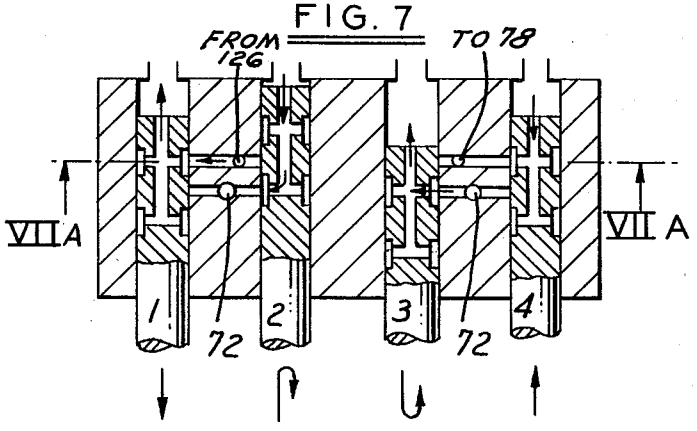
Figure 7A:
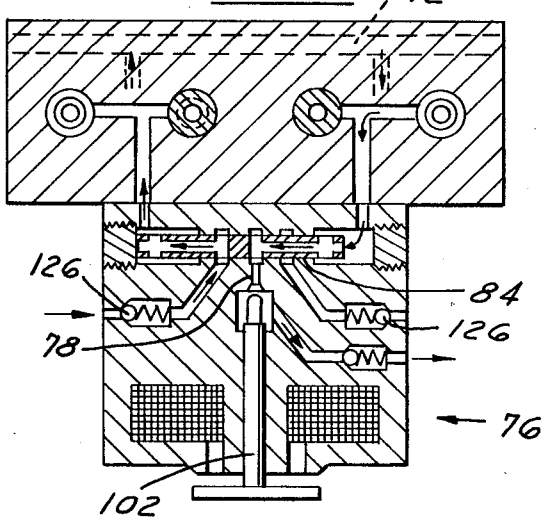

In FIGS. 7 and 7A, the shuttle valve is in the extreme left hand position. The shift in the shuttle valve position took place when Plunger No. 4 began to communicate with the spill port 78 on the upstroke of the plunger. Plunger No. 1 is in the middle of the downstroke, and its plunger barrel is in communication with the inlet check valve 126. Plunger No. 2 is approaching the TDC, and its plunger barrel is in communication with the supply gallery 72. Plunger No. 3 is approaching the BDC and its plunger barrel is also in communication with the supply gallery 72. Plunger No. 4 is in the middle of the upstroke and its plunger barrel is in communication with the spill port 78. Activation of the solenoid results in injection by Plunger No. 4.

Figure 8:
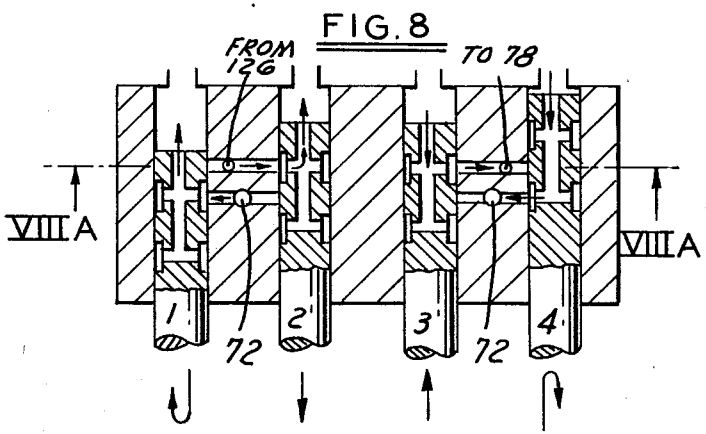
Figure 8A:
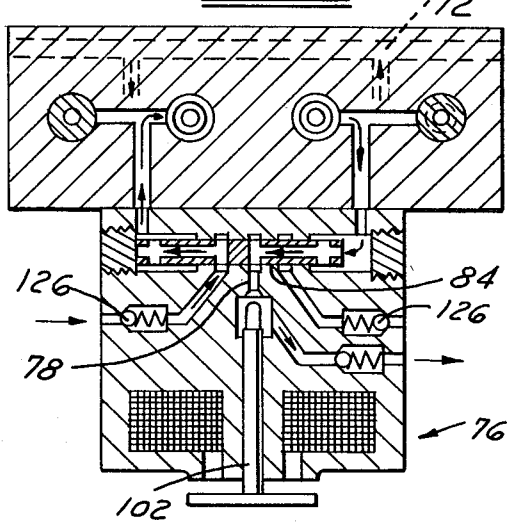

In FIGS. 8 and 8A, the shuttle valve is still in the extreme left hand position. Plunger No. 1 is approaching the BDC and its plunger barrel is in communication with the supply gallery 72. Plunger No. 2 is in the middle of the downstroke, and its plunger barrel is in communication with the inlet check valve 126. Plunger No. 3 is in the middle of the upstroke and its plunger barrel is in communication with the spill port 78. Plunger No. 4 is approaching the TDC and its plunger barrel is in communication with the supply gallery 72. Activation of the solenoid results in injection by Plunger No. 3.

When Plunger No. 1 begins to communicate with the spill port 78 on the upstroke of the plunger, the shuttle valve will again shift to the extreme right-hand position, and the entire sequence will be repeated.

As seen in FIG. 2, the spill port control valve 102 is designed so that the injection pressure forces acting on it are in balance, and thus, only a small solenoid force is needed to keep the spill valve closed. Referring to FIG. 2, the spill valve has a a central bore 152 that connects the spill port 78 with the inside of cap 110. When the solenoid is activated and the spill valve 102 closes the spill port 78, the cap 110, which is slidingly installed on the upper end 154 of the spill valve, remains pressed against the stop 112. During the injection, the spill valve 102 is subjected to a pressure force acting from the spill port 78 upwardly and a counterbalancing pressure force acting from the inside of cap 110 on the end 154 downwardly. Since the fuel pressure at both ends of the central bore 152 is the same, the two forces can balance each other if a proper diameter of the end 154 is selected. Usually, the balance is achieved when the end diameter is equal to the spill valve gage diameter. It should be noted that in many instances, the spring 108 will not be necessary, since the fuel pressure will keep the cap 110 in place.

Figure 9:
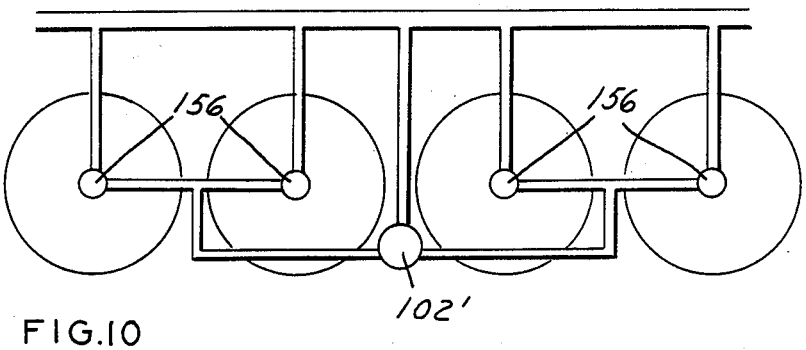
FIGS. 9, 10, 10A and 11 are further crosssectional views illustrating still further embodiments of the invention.

The above-described system, in which a single solenoid valve controls a multi-plunger fuel injection pump, can be also applied to unit injectors. FIG. 9 schematically illustrates a four cylinder engine with a unit injector 156 in each cylinder. A single solenoid controlled spill valve 102' installed on the cylinder head controls four unit injectors in the same manner as was described for the four plunger pump of FIGS. 1–8.

Figure 10:
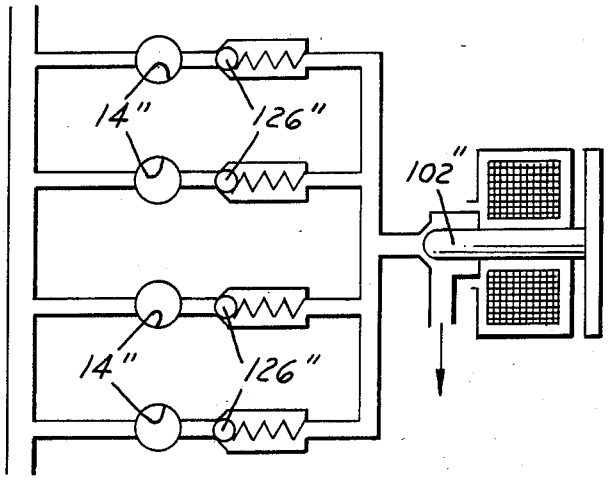
Figure 10A:
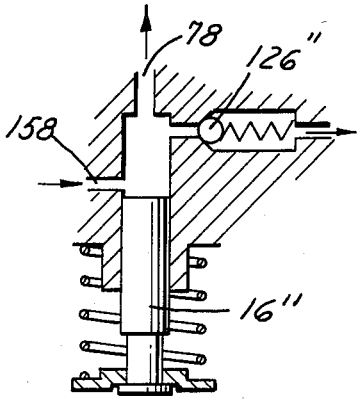

Control of a multi-plunger pump by a single solenoid valve can also be accomplished in other ways. FIGS. 10 and 10A show a system in which the spill port valve 102″ is connected to each plunger barrel 14″ through a check valve 126″. Fuel is supplied to each plunger barrel through a supply port 158 (FIG. 10A) which is open only when the plunger 16″ is in the lower part of its stroke. When the solenoid is activated and the spill port 78″ is closed, two plungers are moving downward; and, of the two plungers moving upward, one has the supply port open. Only the upwardly moving plunger with closed supply port will inject fuel. Thus, whenever the solenoid is activated, only one plunger performs injection.

Figure 11:
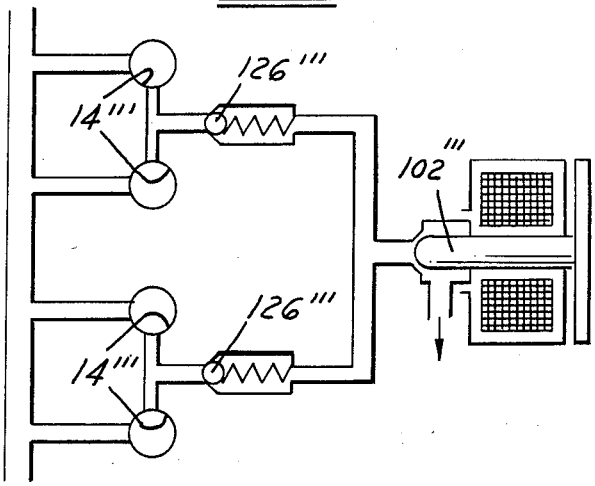

FIG. 11 shows still another example of a multi-plunger system controlled by a single solenoid valve 102‴. In this system, there are two check valves 126‴, each connecting the solenoid valve to a passage connecting a pair of adjacent plunger barrels 14‴. The internal connections between the plunger barrels and the working order of plungers are similar to those in the pump shown in FIG. 1. Therefore, only one plunger barrel with upward moving plunger is connected at any one tme to the spill port control valve 102‴; and, whenever the solenoid is activated, only one plunger performs injection.

It should be noted that the quantity of fuel injected into each engine cylinder during any particular operating phase of the engine will be determined solely as a function of the time that the spill control valve 78 is closed. Control of the duration of the energization of the solenoid will be made by a suitable engine control, not shown, such as a microprocessor unit, for example, which will have a plurality of input parameters, such as engine speed, manifold vacuum level, temperature, etc. The microprocessor unit will determine during particular engine speed and load and other conditions the appropriate quantity of fuel for injection into the particular engine cylinder and the appropriate voltage then will be supplied to thue solenoid assembly 68 to close the spill valve to provide that amount of fuel delivery.

From the foregoing, it will be seen that the invention provides an economical and efficient fuel injection pump assembly, and one in which only a single solenoid need be used to control the flow of fuel to and from all of the pump plunger barrels and their associated fuel chambers.

We claim:

1. A fuel injection pump of the multiple plunger spill port type for an automotive type internal combustion engine, the pump including a plurality of at least four axially spaced engine camshaft driven pump plungers grouped in pairs and sequentially and in succession moved in one direction through a fuel pumping stroke and oppositely through a fuel intake stroke, a fuel pressurization/supply chamber contiquous to the end of each plunger for pressurization of the fuel therein or supply of fuel thereto from a supply passage upon coordinate movement of the plunger, fill/spill passage means connected to a single fuel return spill port and in parallel flow relationship to each of the plunger bores as a function of the position of the plungers, each plunger having a pair of internal passages connected at all times to its chamber and alternately alignable with the supply or fill/spill passage means as a function of the position of the plunger, a fuel discharge passage operatively connecting each of the chambers to an individual engine cylinder, a single spill port control valve movable to block or permit the spill of fuel through the spill port to a return line to control the pressurization of fuel in all of the fuel chambers and associated discharge passages, a single solenoid connected to the spill control valve for moving it to block or unblock the spill port, and a single shuttle valve operatively associated with all of the fill/spill passage means and spill port reciprocably movable between positions to sequentially connect the plunger chambers one at a time in succession to the spill port during the pumping pressurization stroke of its plunger for the injection of fuel to an individual cylinder while the other chambers are in various stages of being refilled with fuel and preparing for pressurization upon successive actuation of the plungers by the camshaft.

2. A fuel injection pump of the multiple plunger spill port type for an automotive type internal combustion engine, the pump including a housing having a central cavity therein receiving a rotatable engine driven camshaft, a plurality of axially spaced stationary pump plunger bores each projecting radially through the housing from the camshaft and each reciprocably mounting a plunger therein engageable with the camshaft for movement one at a time in sequence with the others upwardly through a fuel intake stroke, and downwardly through a fuel intake return stroke, each bore defining a fuel pressurization/supply chamber contiguous to the end of the plunger opposite that engaged by the camshaft, first fuel supply passage means connected to a source of low pressure fuel and in parallel flow relationship to each of the plunger bores, a second fill/spill passage means connected to a fuel spill port and in parallel flow relationship to each of the plunger bores at a location axially spaced from the connection thereto of the supply passage means, each plunger having a pair of internal passages connected at all times to its chamber and alternately alignable with the supply of fill/spill passage means as a function of the position of the plunger, a fuel discharge passage containing fuel pressure responsive means therein connecting each of the chambers to an individual engine cylinder, a low pressure fuel return line connected to the fuel spill port, and spill port control valve means movable to block or permit the spill of fuel through the spill port to the return line to control the pressurization of fuel in the fuel chambers and associated discharge passages, the valve means including a single solenoid operated spill control valve movable to block or unblock the spill port, and a shuttle valve operatively associated with the fill/spill passage means and spill port reciprocably movable between positions to sequentially connect the plunger chambers one at a time in succession to the spill port during the pumping/pressurization stroke of its plunger for the injection of fuel to an individual cylinder while the remaining chambers are in various stages of being refilled with fuel and prepared for pressurization upon successive actuation of the plungers associated therewith by the camshaft.

3. A pump as in claim 2, wherein the shuttle valve is movable to a first position connecting one plunger chamber of a first pair of plunger chambers to the spill port and all of the remaining plunger chambers to the fuel supply, and sequentially upon rotation of the camshaft connecting the plunger chamber of the other of the one pair of chambers to the spill port and disconnecting the first mentioned chamber therefrom, and movable to a second position connecting one plunger chamber of a second pair of plunger chambers to the spill port and all of the remaining chambers to the fuel supply, and sequentially upon rotation of the camshaft connecting the other of the plunger chambers of the second pair to the spill port and disconnecting the one of the second pair of chambers from the spill port.

4. A pump as in claim 3, wherein the shuttle valve is fuel pressure movable to its reciprocable positions by the fuel being connected from a particular fuel chamber to the spill port directed against portions of the shuttle valve.

5. A pump as in claim 2, the shuttle valve including a valve bore having an outlet connected to the spill port and having a pair of inlets at opposite ends, each connected to the fill/spill passage, and therefrom to a pair of plunger bores for connection of one of the internal passages of the plungers thereto on a selective basis as a function of the sequential reciprocatory position of the plungers, the selective energization of the solenoid closing the spill port during the pumping stroke of one of the plungers to effect pressurization of its associated fuel chamber and the discharge of fuel to the engine cylinder associated therewith simultaneous with the various stages of supplying of fuel to the remaining of the plunger chambers.

6. A pump as in claim 2, wherein each bore contains a retraction type fuel delivery valve contiguous to the fuel chamber and concentrically arranged within the bore to close one end thereof, the delivery valve connecting the latter chamber and discharge passage and being openable upon the attainment of a predetermined fuel pressure in the chamber to supply fuel to the engine cylinder.

7. A pump as in claim 2, wherein the plunger bores are grouped in pairs, with a single fuel fill/spill passage common to each plunger bore of a pair, first and second ones of the fill/spill passages being connected respectively to opposite ends of the shuttle valve for moving the same in one direction or the other as a function of which end is connected to a fuel plunger chamber being pressurized during the sequential successive actuation of the plunger by the camshaft, the plunger chambers not being pressurized being refilled with fuel at a pressure level sufficiently lower than that of the chamber being pressurized to provide the pressure differential between the opposite ends of the shuttle valve necessary to effect movement of the valve.

* * * * *